US009303888B2

(12) United States Patent
Karst et al.

(10) Patent No.: US 9,303,888 B2
(45) Date of Patent: Apr. 5, 2016

(54) VENTILATION SYSTEM AND METHOD

(75) Inventors: Daniel L. Karst, Beaver Dam, WI (US); John R. Adrian, Oshkosh, WI (US); Mirko Zakula, New Berlin, WI (US); Robert G. Penlesky, Waukesha, WI (US)

(73) Assignee: Broan-NuTone LLC, Hartford, WI (US)

( * ) Notice: Subject to any disclaimer, the term of this patent is extended or adjusted under 35 U.S.C. 154(b) by 377 days.

(21) Appl. No.: 13/367,258

(22) Filed: Feb. 6, 2012

(65) Prior Publication Data

US 2013/0203336 A1 Aug. 8, 2013

(51) Int. Cl.
*F24F 7/06* (2006.01)
*F24F 7/04* (2006.01)

(52) U.S. Cl.
CPC .... *F24F 7/06* (2013.01); *F24F 7/04* (2013.01)

(58) Field of Classification Search
CPC ..... F24F 7/04; F24F 7/06; F24F 13/10; F24F 13/12; F24F 2011/0098
USPC ..... 454/249, 258, 237, 309, 342, 357, 354, 454/369, 257; 236/49.2, 49.3, 49.5
See application file for complete search history.

(56) References Cited

U.S. PATENT DOCUMENTS

| | | | | | |
|---|---|---|---|---|---|
| 1,788,556 | A | * | 1/1931 | Wood et al. | 454/205 |
| 3,538,975 | A | * | 11/1970 | Metti et al. | 160/1 |
| 3,677,517 | A | * | 7/1972 | Root et al. | 251/366 |
| 4,773,310 | A | * | 9/1988 | Corwin | 454/244 |
| 5,171,184 | A | * | 12/1992 | Saucier et al. | 454/257 |
| 2008/0224006 | A1 | * | 9/2008 | Call et al. | 248/231.9 |

FOREIGN PATENT DOCUMENTS

| | | | | |
|---|---|---|---|---|
| GB | 1593046 | * | 7/1981 | A62C 3/14 |

* cited by examiner

*Primary Examiner* — Gregory Huson
*Assistant Examiner* — Dana Tighe
(74) *Attorney, Agent, or Firm* — Schwegman Lundberg & Woessner, P.A.

(57) ABSTRACT

Embodiments of the invention provide a ventilation system comprising a housing. The housing includes an inlet through which air is received and the housing is capable of being installed within a structure. A ventilating assembly can be supported within an interior of the housing. The ventilating assembly can be operable to generate a flow of air and can be in fluid communication with the inlet. The system can include a thermal damper assembly comprising an aperture and a substantially non-metallic curtain. The damper assembly is capable of being coupled to the housing so that the aperture of the thermal damper assembly and the inlet of the housing are in fluid communication with each other. In some embodiments, the thermal damper assembly is configured and arranged to be uncoupled from the housing after the housing has been installed within the structure to provide access to the interior of the housing.

18 Claims, 16 Drawing Sheets

VENTILATION SYSTEM AND METHOD

BACKGROUND

Conventional ventilation systems can be installed within structures, such as buildings. Some of these conventional systems can function to exhaust air and other fluids from the structures. For example, some of these conventional ventilation systems can be coupled to a duct system of the structure, which can provide a path for the exhausted air to exit the structure. However, in the event of a fire within the structure, at least some of the conventional ventilation systems can enable the fire to relatively rapidly spread throughout the structure because the ventilation systems can be installed through walls of the structure and connected to the duct system. Although some of these conventional ventilation systems may include apparatuses or systems that can retard or prevent the spread of fire or fire-related effluent and debris through the structure, the inclusion of some of these apparatuses or systems can impede or prevent access to an interior of the conventional systems for maintenance or other purposes.

SUMMARY

Some embodiments of the invention provide a ventilation system comprising a housing. The housing can include an inlet through which air can be received and the housing can be capable of being installed within a structure. In some embodiments, a ventilating assembly can be supported within an interior of the housing. The ventilating assembly can be operable to generate a flow of air and can be in fluid communication with the inlet. In some embodiments, the ventilation system can include a thermal damper assembly that can comprise an aperture and a substantially non-metallic curtain. In some embodiments, the damper assembly can be capable of being coupled to the housing so that the inlet of the thermal damper assembly and the aperture of the housing can be in fluid communication with each other. In some embodiments, the thermal damper assembly can be configured and arranged to be uncoupled from the housing after the housing has been installed within the structure to provide access to the interior of the housing through the inlet of the housing.

DETAILED DESCRIPTION

Figure 1:
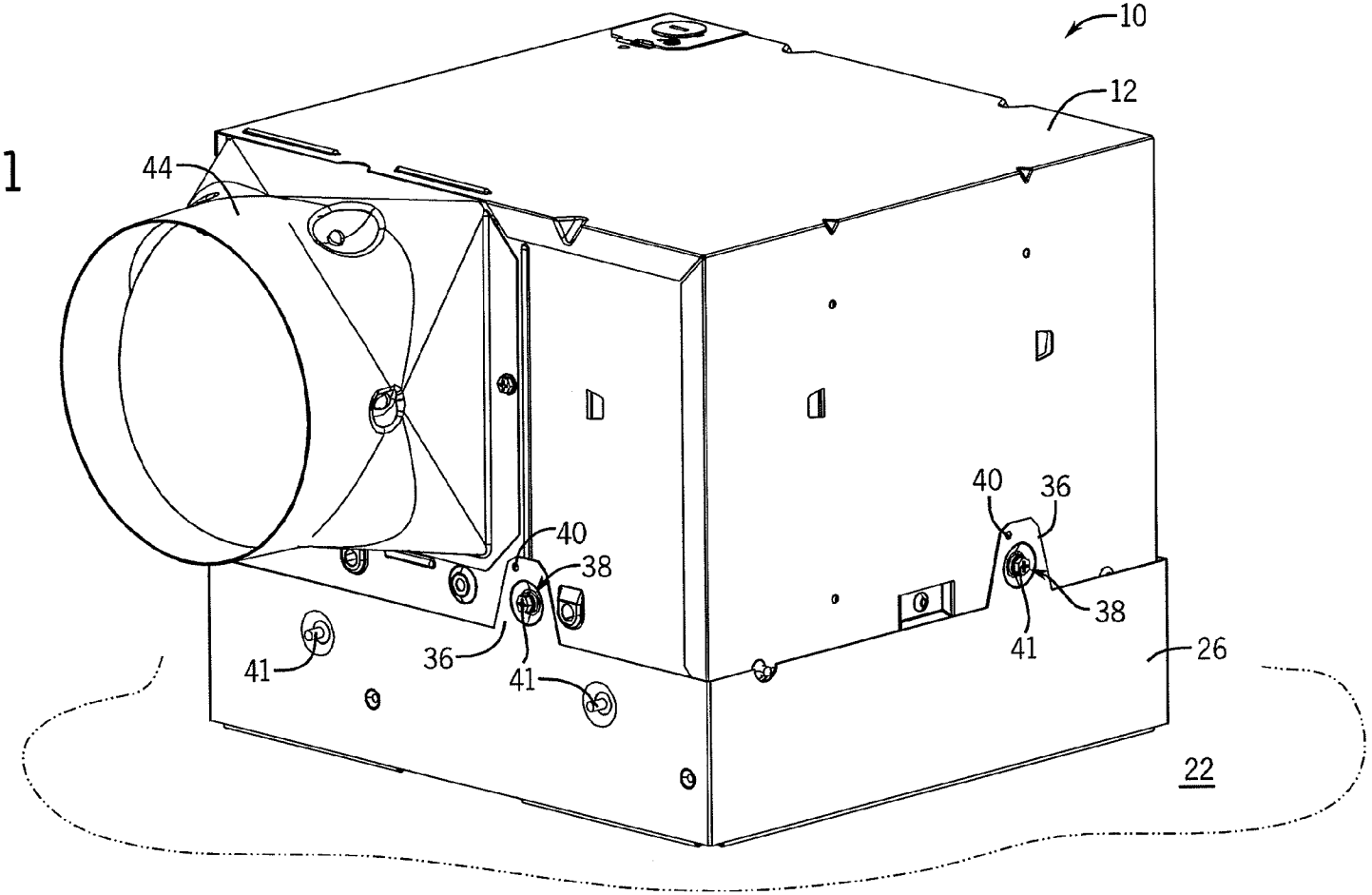
FIG. 1 is a top perspective view of a ventilation system according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

FIG. 1 illustrates a ventilation system 10 according to one embodiment of the invention. The ventilation system 10 can include a housing 12, which can be configured and arranged to receive at least some components of the system 10. In some embodiments, the housing 12 can comprise one or more inlets 14 and one or more outlets 16 defined through portions of the housing 12. In some embodiments, the ventilation system 10 can include a ventilating assembly 18, at least one mounting apparatus 20 which can be used to couple the ventilating system 10 (e.g., the housing 12) to a portion of a structure, a grille 24, and an adaptor 26.

In some embodiments, the ventilation system 10 can be configured and arranged to provide illumination to a room, an area, or a space. For example, the ventilation system can comprise a conventional lamp housing (not shown), one or more conventional illumination devices (not shown), and a conventional lens (not shown) disposed through a portion of the grille 24. In some embodiments, the system 10 can be used to illuminate and/or ventilate any room, area, or space. In some embodiments, the system 10 can illuminate the room, area, or space independently of ventilating the room, area, or space. Moreover, in some embodiments, the system 10 can be configured and arranged to substantially only ventilate the room, area or space. In other embodiments, the system 10 can be configured and arranged to substantially only illuminate the room or area.

As shown in FIG. 1, in some embodiments, the housing 12 can comprise any material which can withstand varying temperatures (e.g., to withstand any heat radiated and/or conducted from the illumination devices, the motor, or other components) while providing structural support to the system 10. In some embodiments, the housing 12 can be formed of sheet metal; however, the housing 12 also can be fabricated from ceramic or a polymer comprising a relatively high melting temperature. The housing 12 can be formed into any shape, including, but not limited to, a rectangular box-like shape, an oval shape, a hemispherical shape, a spherical shape, a pyramidal shape, or any other shape. The housing 12 can form a base or a similar support structure of the system 10. Further, in some embodiments, the housing 12 can provide points and areas of attachment for other components of the system 10, as described in further detail below.

Figure 2:
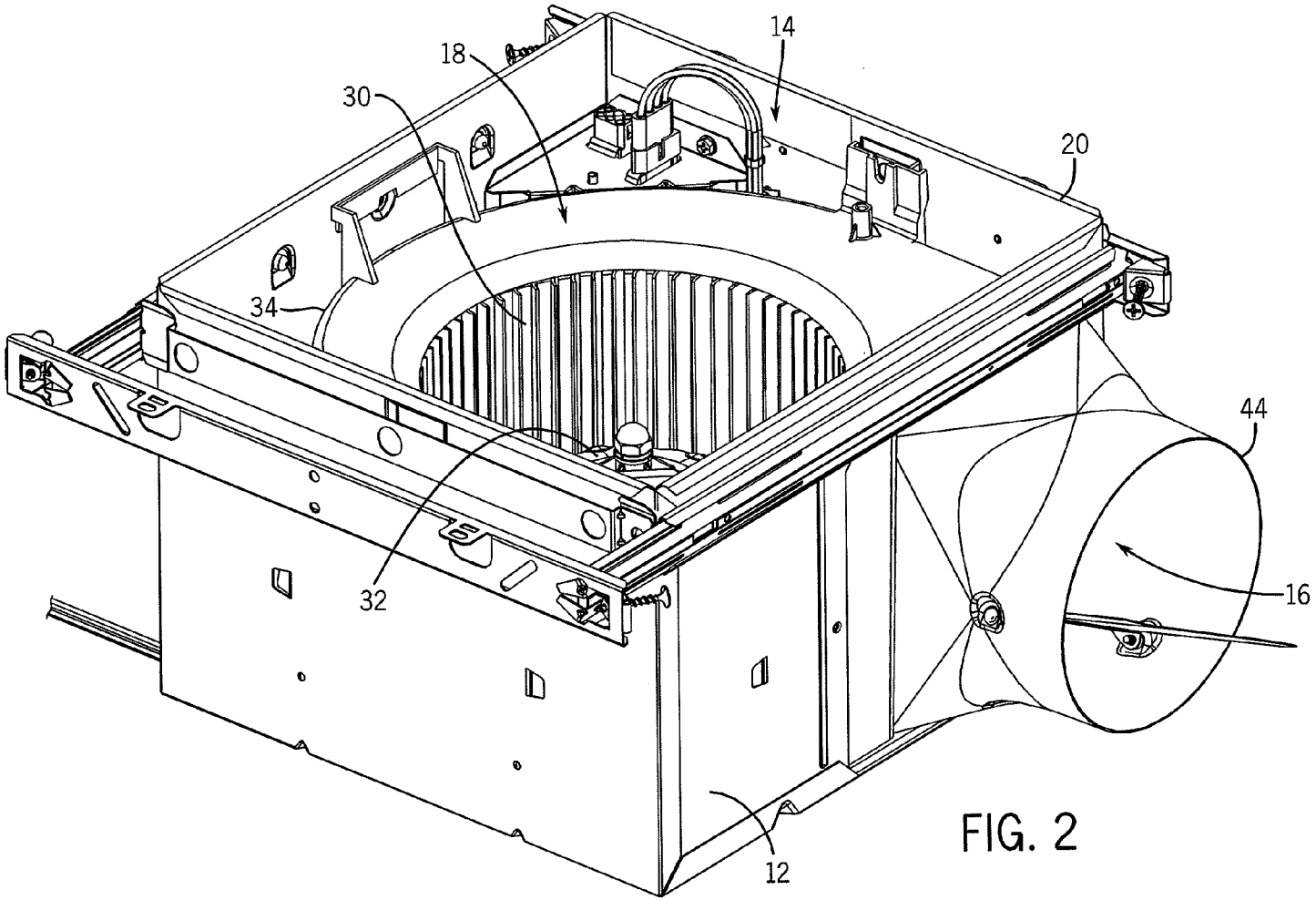
FIG. 2 is a bottom perspective view of a ventilation system according to one embodiment of the invention.
Figure 3:
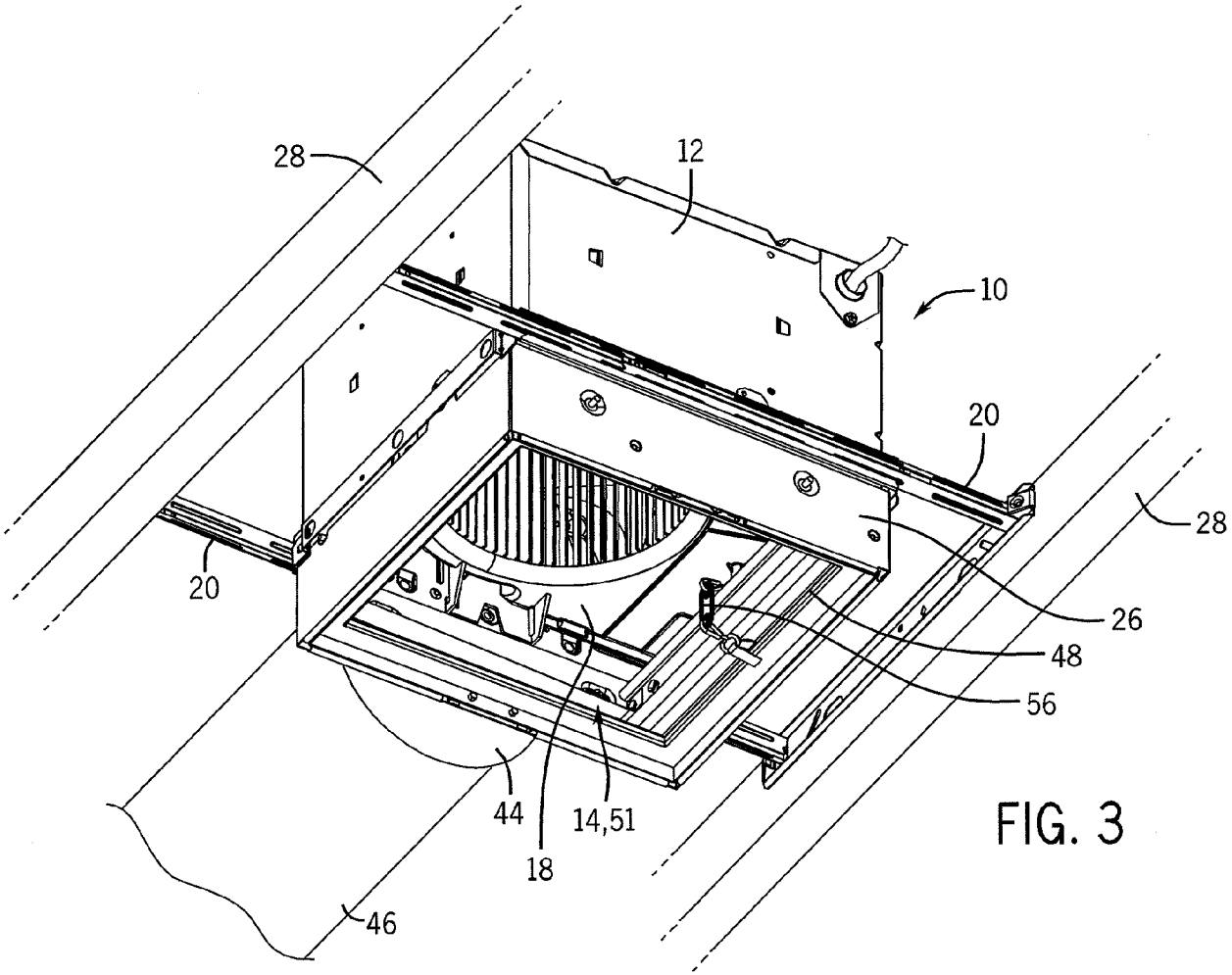
FIG. 3 is a perspective view of a ventilation system installed within a structure according to one embodiment of the invention.
Figure 4:
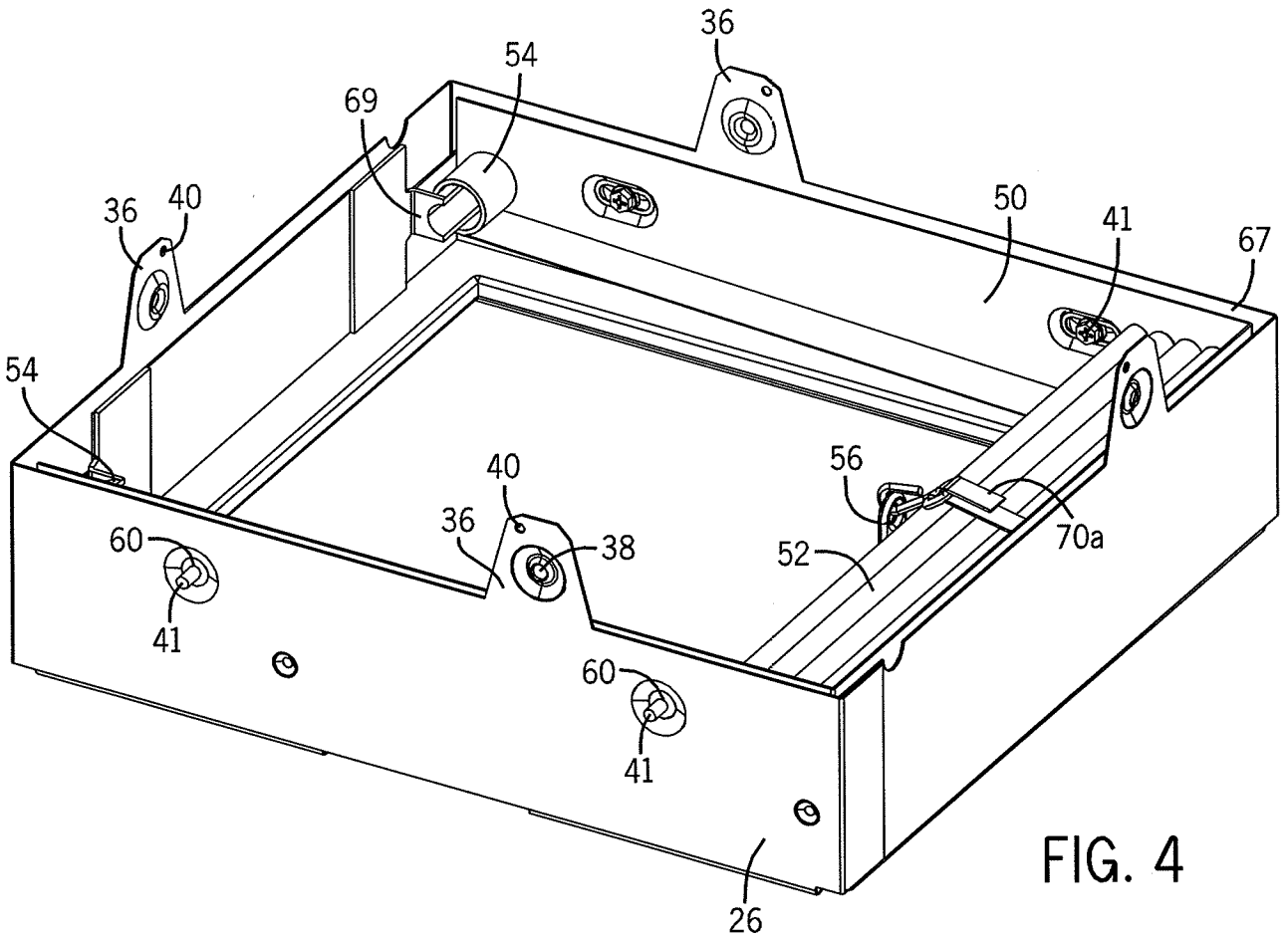
FIG. 4 is a perspective view of a thermal damper assembly and an adaptor according to one embodiment of the invention.

As shown in FIGS. 2 and 3, in some embodiments, the housing 12 can be used in conjunction with the mounting apparatus 20 for installing the system 10 within any portion of the structure. Any type of mounting apparatus 20 can be included with the housing 12. The mounting apparatus 20 can be positioned on the housing 12 so that the housing 12 can be supported with respect to the surrounding structure. In other embodiments, the housing 12 can be coupled to a support structure or a surface using a variety of fasteners and coupling methods.

For example, as shown in FIGS. 2 and 3, in some embodiments, the mounting apparatus 20 can be coupled to an exterior of the housing 12. In some embodiments, the mounting apparatus 20 can be coupled to the housing 12 via one or more snap-fit features (not shown) and/or one or more coupling devices (not shown) (e.g., screws, nails, bolts, etc.). In other embodiments, the mounting apparatus 20 can be substantially or completely integral with the housing 12.

In some embodiments, the mounting apparatus 20 can be adjustable to enable installation of the ventilation system 10 in multiple structures comprising different configurations. In some embodiments, a portion of the mounting apparatus 20 can be extendable and/or compressible to enable installation in different situations. By way of example only, as shown in FIG. 3, in some embodiments, the mounting apparatus 20 can be installed between at least two structure support elements 28 (e.g., joists) and a length of the mounting apparatus 20 can be adjusted so that lateral ends of the mounting apparatus 20 can be disposed immediately adjacent to, and coupled to, the support elements 28 to enable installation of the ventilation system 10 within the structure.

In some embodiments, the ventilating assembly 18 can be at least partially disposed within the housing 12. For example, as shown in FIGS. 2 and 3, the ventilating assembly 18 can be coupled to an interior of the housing 12 and positioned so that the ventilating assembly 18 is in fluid communication with the inlet 14 and the outlet 16. In some embodiments, the ventilating assembly 18 can include a centrifugal fan or fan wheel 30 connected to a motor plate (not shown) or other structure within the housing 12. In some embodiments, any other type of fan other than a centrifugal or fan wheel 30 can be employed, including propeller-type fans. In some embodiments, the system 10 can include a motor 32 connected to the motor plate by a bracket (not shown). The motor 32 can include a motor shaft, which can extend through the bracket and/or the motor plate to produce ventilating airflow. In some embodiments, the ventilating assembly 18 can be removeably connected within the main housing 14 as a single integral unit.

In some embodiments, when the ventilating assembly 18 is installed within the housing 12, the fan 30 can be supported adjacent to a substantially arcuate, upstanding wall 34. Together with a wall of the housing 12 and the motor plate, the upstanding wall 34 can define a scroll housing for generating airflow. In some embodiments, the fan wheel 30 can be positioned relative to the upstanding wall 34 to receive air or other fluids through the inlet 14, and exhaust the air or other fluids through the outlet 16. As a result, in some embodiments, the ventilating assembly 18 can be installed and/or supported within the interior of the housing 12 and operable to generate a flow of air through the inlet 14 and exhaust at least a portion of the air through the outlet 16.

In some embodiments, the housing 12 can comprise the adaptor 26. For example, in some embodiments, the housing 12 can be coupled to the adaptor 26. As shown in FIGS. 1 and 4-7, in some embodiments, the adaptor 26 can comprise one or more flanges 36 that can be configured and arranged to couple together the adaptor 26 and the housing 12. For example, as shown in FIGS. 1 and 4-7, the adaptor 26 can comprise four flanges 36 and some or all of the flanges 36 can comprise flange apertures 38 that are configured and arranged to receive a coupling device 41 (e.g., a screw, a nail, a bolt, etc.). In some embodiments, the housing 12 can comprise one or more apertures (not shown) that can be configured and dimensioned to enable the coupling together of the housing 12 and the adaptor 26. For example, as shown in FIG. 1, the adaptor 26 can be positioned so that the apertures of the housing 12 substantially or completely align with the flange apertures 38 so that the one or more of the coupling devices 41 can be disposed through the aligned apertures and flange apertures 38 to coupled together the housing 12 and the adaptor 26. By way of further example, in some embodiments, each side of the housing 12 (e.g., four sides a rectangular or square-shaped housing 12) can comprise an aperture and the adaptor 26 can comprise four flanges 36 and four flange apertures 38 to align with each side of the housing 12. Additionally, in some embodiments, the adaptor 26 can be coupled to the housing 12 at a position substantially adjacent to the inlet 14 so that the inlet 14 is substantially or completely unobstructed by the adaptor 26, as shown in FIG. 8. For example, as shown in FIG. 3, the adaptor 26 can be coupled to the housing 12 and then the mounting apparatus 20 can be coupled to the housing 12 so that portions of the mounting apparatus 20 are disposed immediately adjacent to one or more of the flanges 36. In some embodiments, the adaptor 26 can be integral with respect to the housing 12.

Figure 9:
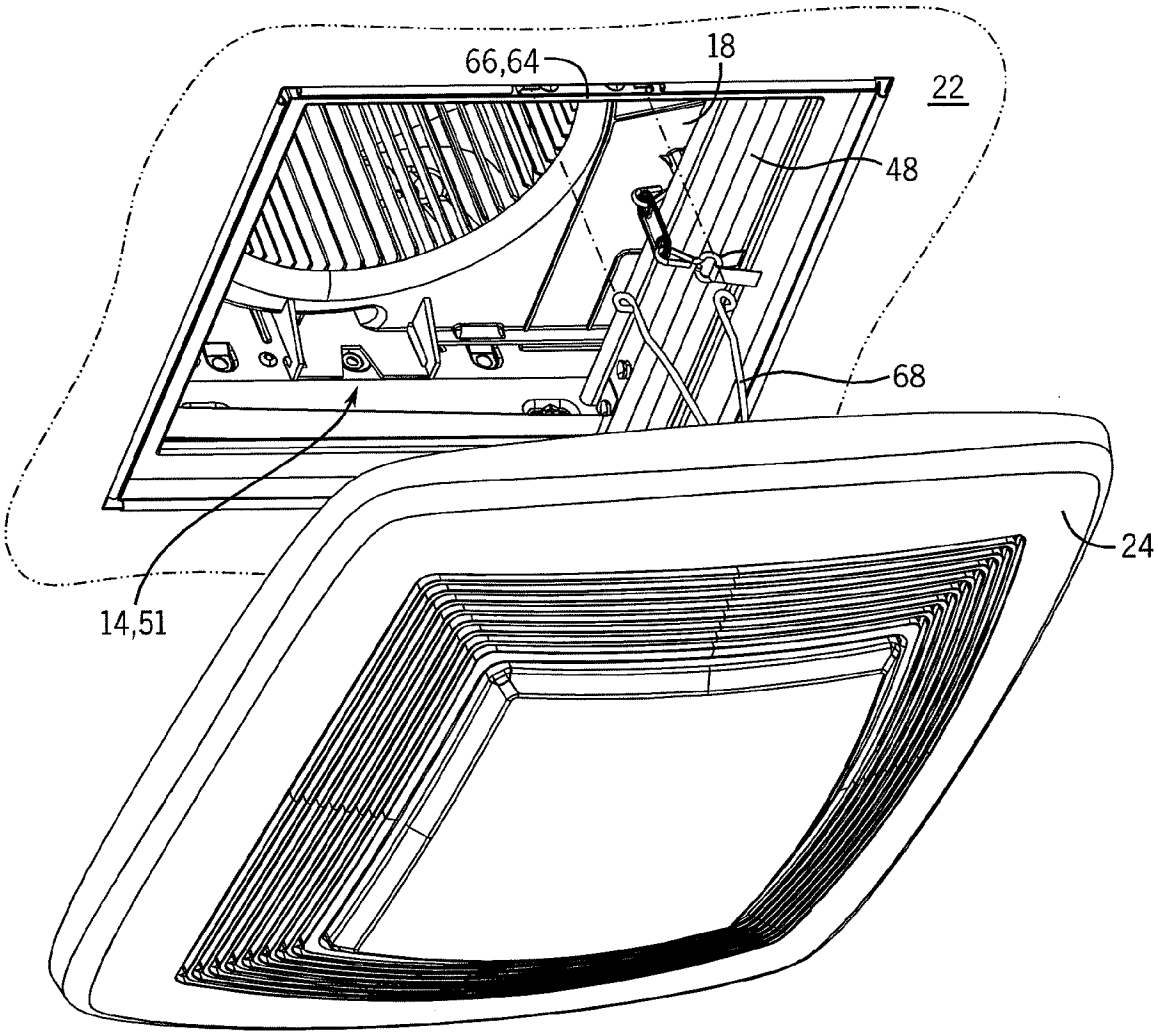
FIG. 9 is a perspective view of a ventilation system installed within a structure according to one embodiment of the invention.

As shown in FIGS. 1, 4-7, and 9, in some embodiments, at least one of the housing 12 and the adaptor 26 can comprise one or more mounting apertures 40. By way of example only, in some embodiments, one or more of the flanges 36 can comprise the mounting apertures 40. As shown in FIGS. 1, 4-7, and 9, the mounting apertures 40 can be defined through the flanges 36 and can be configured and arranged to aid in installing the ventilation system 10 within the structure. In some embodiments, as shown in FIG. 9, one or more mounting wires 42 can be disposed through at least some of the mounting apertures 40 to at least partially support the housing 12 within the structure. For example, in some embodiments, a first end of the mounting wires 42 can be coupled to (e.g., securely anchored) a portion of the structure and a second end of the mounting wires 42 can be fed through at least some of the mounting apertures 40 to suspend, hang, or otherwise support the ventilation system 10 within the structure. As shown in FIG. 9, in some embodiments, the mounting wires 42 can be tied to themselves to retain the housing 12 in position, however, in other embodiments, the mounting wires 42 can be otherwise secured (e.g., welding, brazing, soldering, etc.) so that the wires 42 support the housing 12 during the life of the ventilation system 10.

As shown in FIG. 9, in some embodiments, the ventilation system 10 can be installed within the structure so that a lateral edge of the housing 12 and/or the adaptor 26 is substantially or completely even, flush, or otherwise non-extended through a wall 22 or other support member of the structure. By way of example only, as shown in FIG. 9, the ventilation system 10 can be installed within a wall 22 of a room (e.g., a bathroom, bedroom kitchen, office, or any other room of any other structure) so that the housing 12 and/or the adaptor 26 is substantially flush with, and/or recessed with respect to the wall 22 and so that the housing 12 and/or the adaptor 26 do not extend into the room. As described in greater detail below, in some embodiments, the grille 24 can be the only element of the ventilation system 10 that extends from the wall 22. In some embodiments, concealing the housing 12 and its contents can provide aesthetic benefits.

Figure 10:
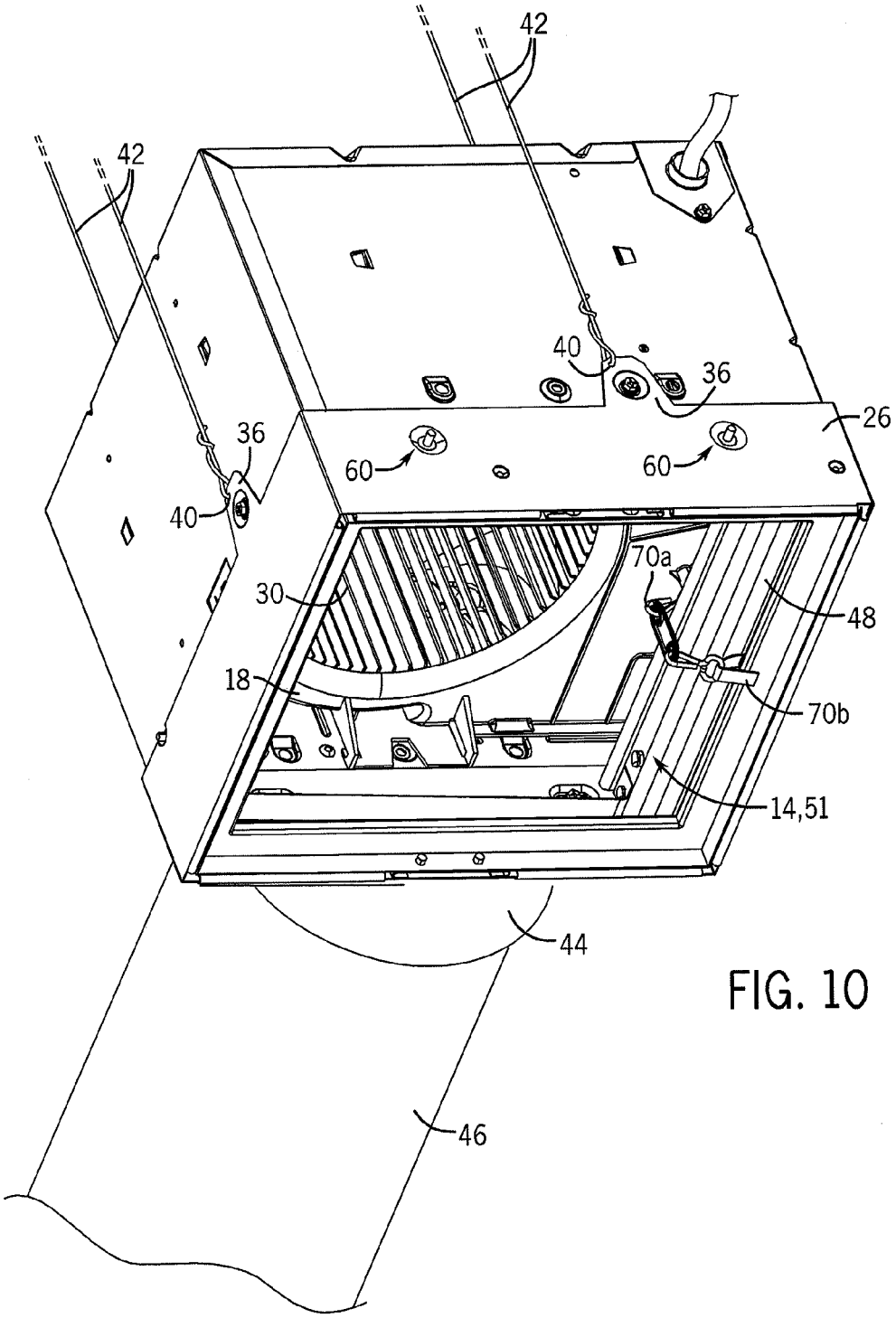
FIG. 10 is a perspective view of a ventilation system installed within a structure according to one embodiment of the invention.

In some embodiments, the ventilation system 10 can comprise a duct connector assembly 44, as shown in FIGS. 1, 3, and 10. In some embodiments, the duct connector assembly 44 can be coupled to the housing 12 at a point substantially adjacent to the outlet 16. As a result, in some embodiments, the duct connector assembly 44 can facilitate air or other fluid flow from the ventilation system 10 to a duct network of the structure. For example, the structure can comprise one or more ducts 46 or other structures that are capable of guiding air flow through the structure. In some embodiments, the ducts 46 can fluidly couple the duct connector assembly 44 to an exhaust outlet (not shown) of the structure. As a result, in some embodiments, when the ventilation system 10 and the ventilating assembly 14 are active, air or other fluids can be drawn from within the structure (e.g., via the inlet 14) and passed through the housing 12 and into the ducts 46 (e.g., via the outlet 16 and the duct connector assembly 44) and out of the structure via the exhaust outlet. In some embodiments, the ventilation system 10 can function without the ducts 46 and/or duct connector assembly 44 and can be directly coupled to the exhaust outlet and/or can directly exhaust air or other fluids within the structure.

Figure 11:
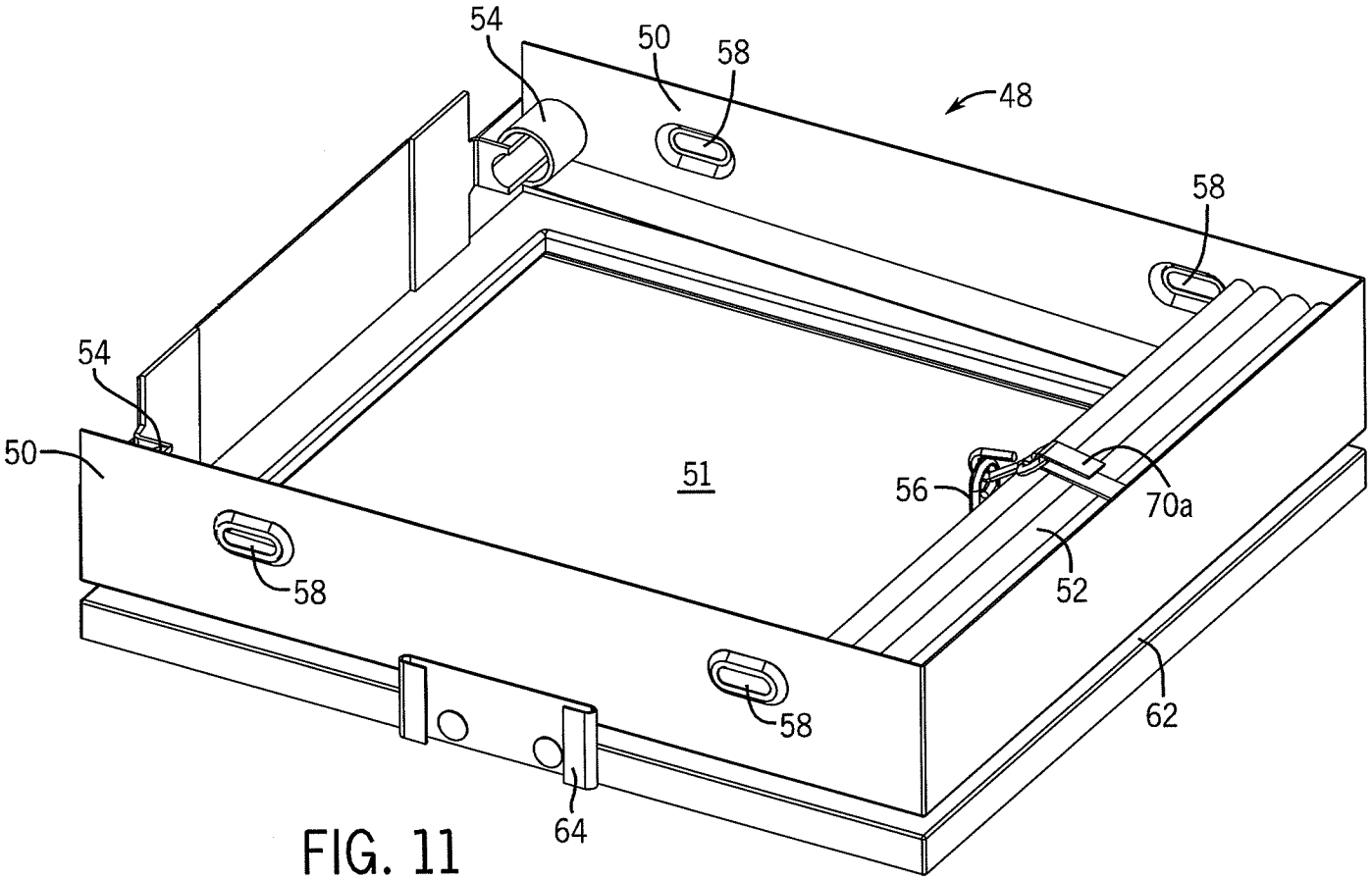
FIG. 11 is a perspective view of a thermal damper assembly according to one embodiment of the invention.
Figure 12:
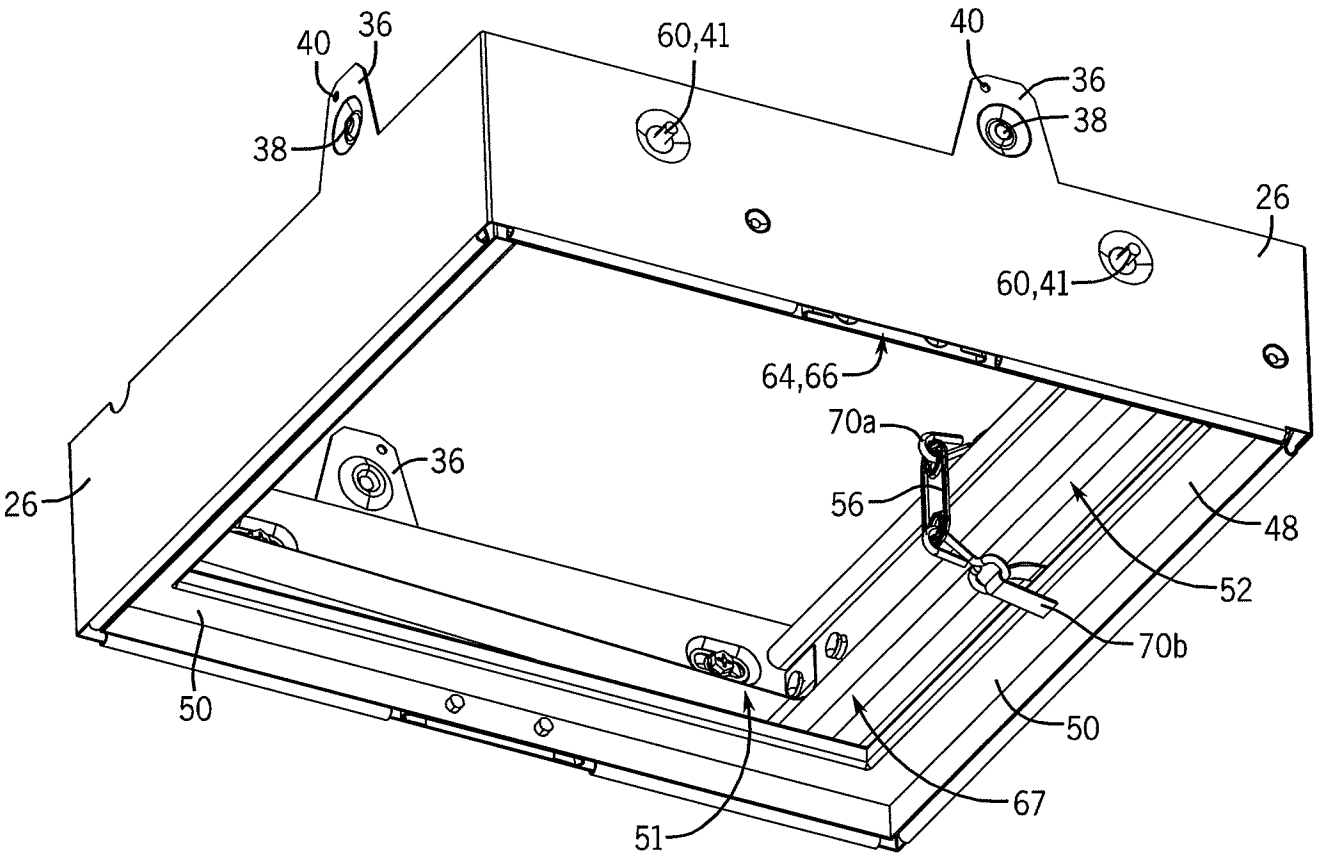
FIG. 12 is a perspective view of a thermal damper assembly and an adaptor according to one embodiment of the invention.

In some embodiments, the ventilation system 10 can comprise at least one thermal damper assembly 48, as shown in FIGS. 4, 5, and 11-13. In some embodiments, the thermal damper assembly 48 can be coupled to at least one of the housing 12 and the adaptor 26. For example, as shown in FIG. 12, the thermal damper assembly 48 can be coupled to the adaptor 26. In some embodiments, the thermal damper assembly 48 can be substantially or completely integral with one of the housing 12 and the adaptor 26. As described in greater detail below, the thermal damper assembly 48 can be configured and arranged to prevent and/or limit the transmission of thermal energy, smoke, effluent, or at least some other byproducts of a thermal episode (e.g., a fire) from passing through the ventilation system 10 and entering the duct network.

In some embodiments, the thermal damper assembly 48 can comprise a frame 50, at least one curtain 52, at least one biasing member 54, and at least one thermal link 56. For example, as shown in FIG. 11, the frame 50 can comprise a substantially similar shape and composition as the housing 12 (e.g., a substantially rectangular- or square-shaped frame 50 can be used with a substantially rectangular- or square-shaped housing 12). In some embodiments, the frame 50 and the housing 12 and/or adaptor 26 can comprise dissimilar shapes and configurations.

In some embodiments, the frame 50 can be configured and arranged to provide support for at least a portion of the elements of the thermal damper assembly 48 and can comprise features that can enable the coupling together of the thermal damper assembly 48 and the housing 12 and/or the adaptor 26. For example, as shown in FIG. 11, in some embodiments, the frame 50 can comprise a hem 62 disposed around at least a portion of its exterior. In some embodiments, the hem 62 can provide support and rigidity to the frame 50 to enhance the structural integrity of the thermal damper assembly 48.

Figure 5:
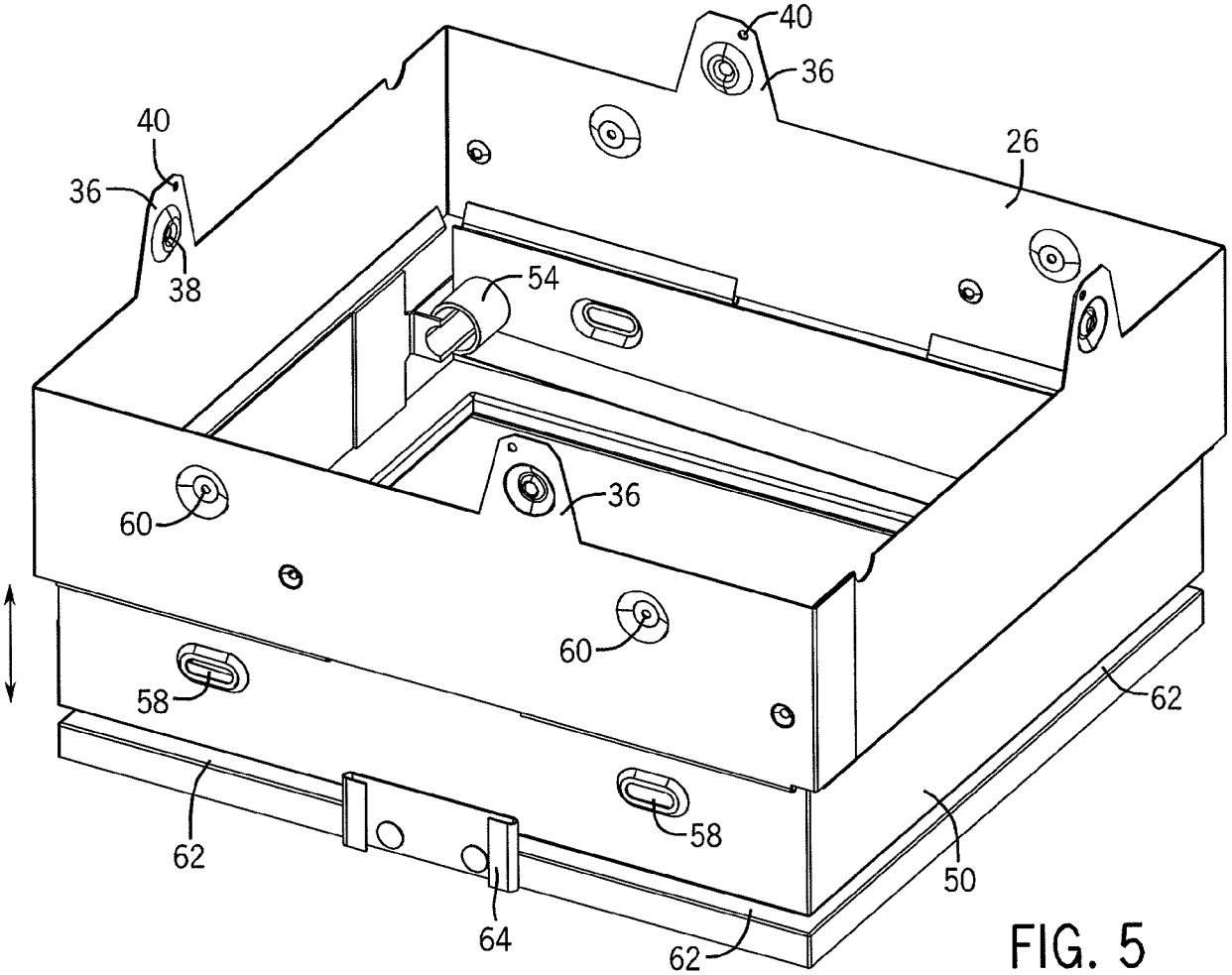
FIG. 5 is another perspective view of the thermal damper assembly and the adaptor of FIG. 4.
Figure 6:
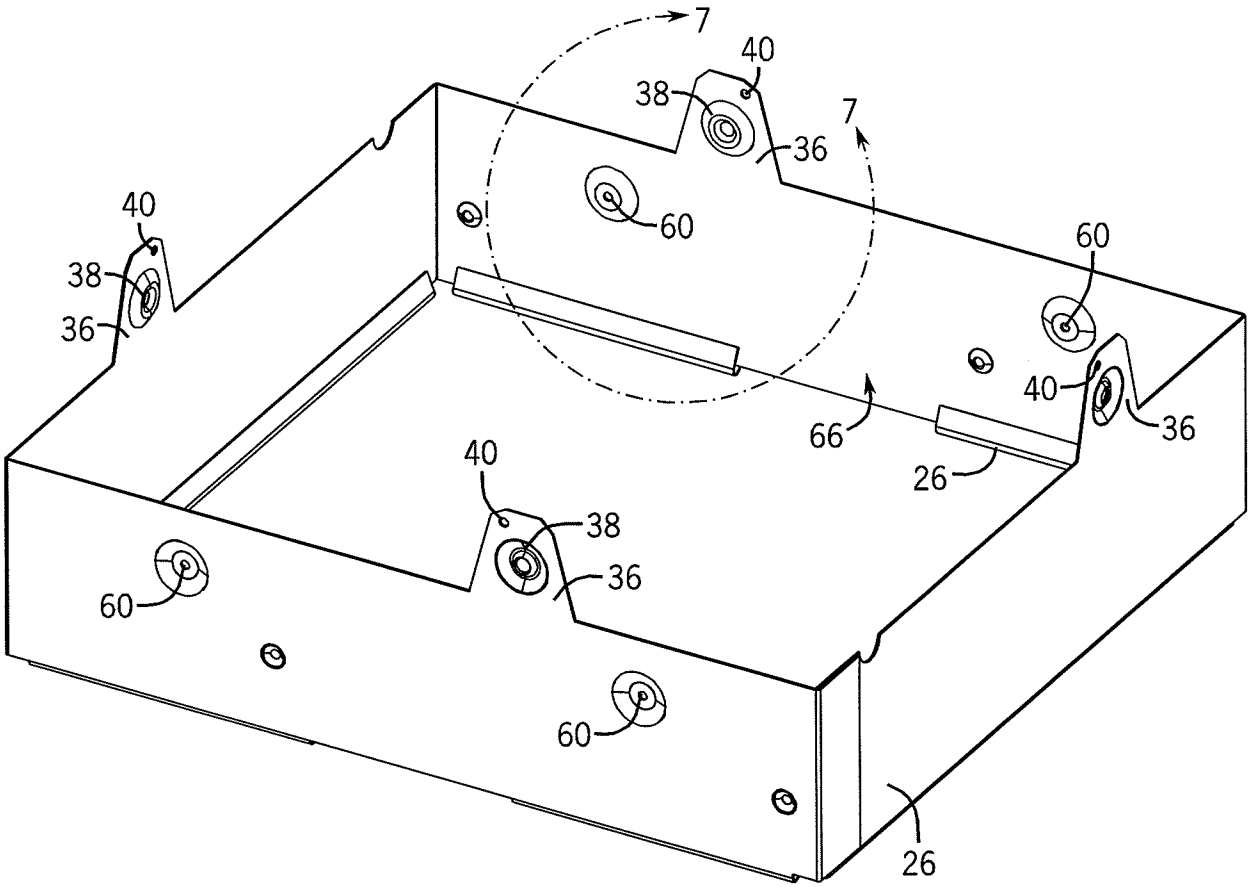
FIG. 6 is a perspective view of the adaptor of FIG. 4.
Figure 13:
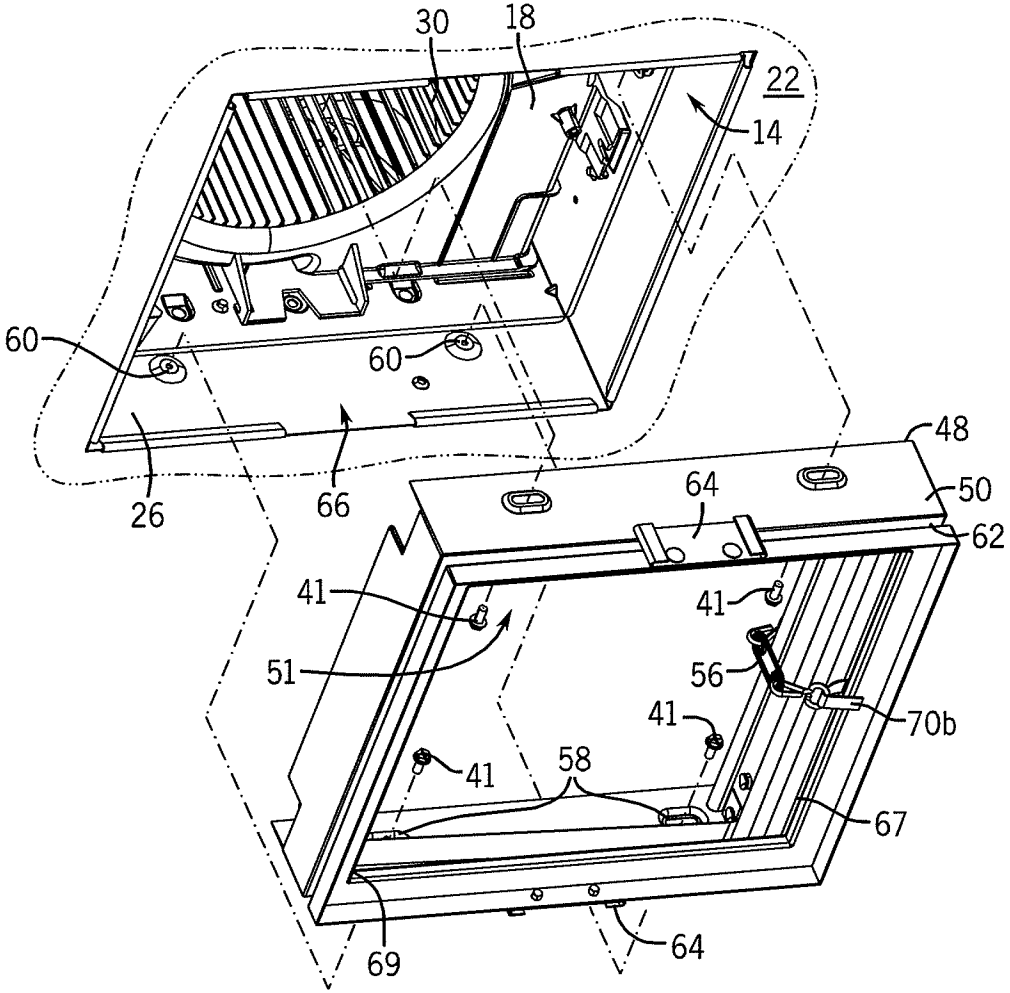
FIG. 13 is a perspective view of the installation and removal of a thermal damper assembly according to one embodiment of the invention.
Figure 14:
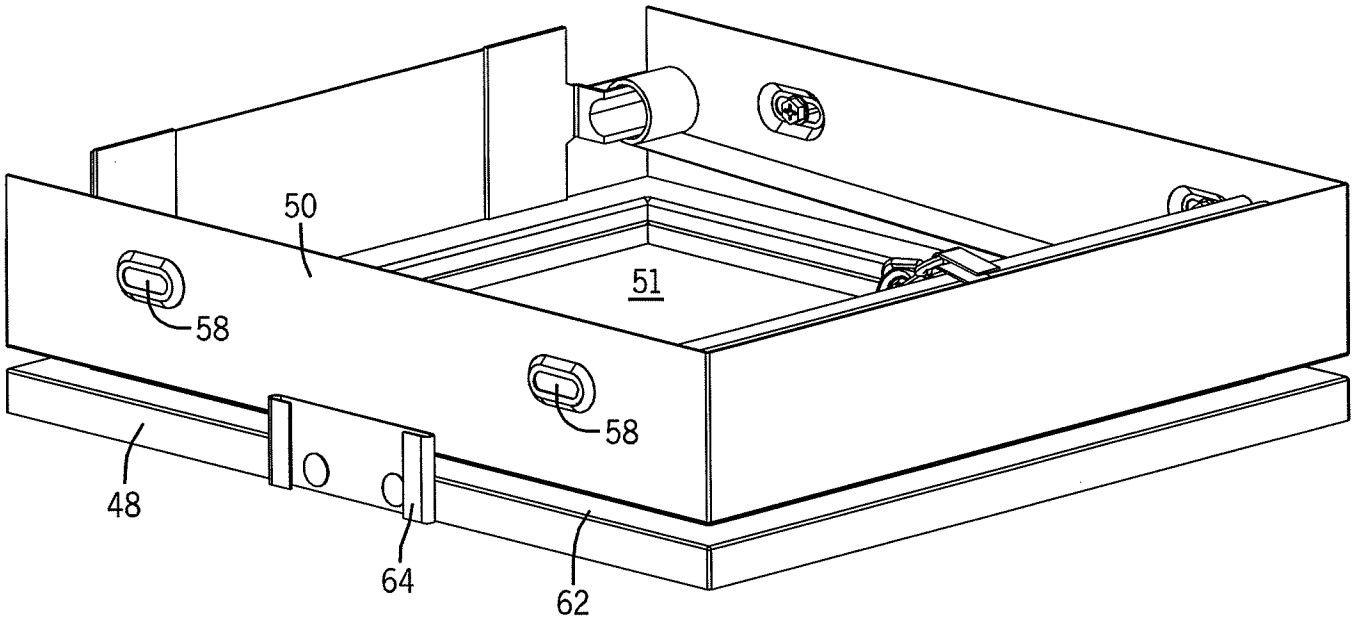
FIG. 14 is an expanded perspective view of a portion of the thermal damper assembly of FIG. 11.

Moreover, as shown in FIGS. 13 and 14, in some embodiments, the frame 50 can comprise one or more frame apertures 58. For example, as shown in FIG. 13, the frame 50 can comprise four frame apertures 58, however, in other embodiments, the frame 50 can comprise greater or few numbers of frame apertures 58. Moreover, as shown in FIG. 5, in some embodiments, the adaptor 26 can comprise one or more damper apertures 60 that are configured and arranged to substantially align with the frame apertures 58 during assembly of the ventilation system 10. For example, as reflected by the dashed lines in FIG. 13, in some embodiments, the frame 50 can be positioned within the adaptor 26 so that the frame apertures 58 substantially or completely align with the damper apertures 60 of the adaptor 26 so that a one or more coupling devices 41 (e.g., screws, nails, thumb screws, bolts, etc.) can be disposed through both apertures 58, 60 to retain the thermal damper assembly 48 within the adaptor 26. Further, as described in greater detail below, in some embodiments, the thermal damper assembly 48 can be uncoupled from the adaptor 26 to access an interior of the housing 12.

Figure 7:
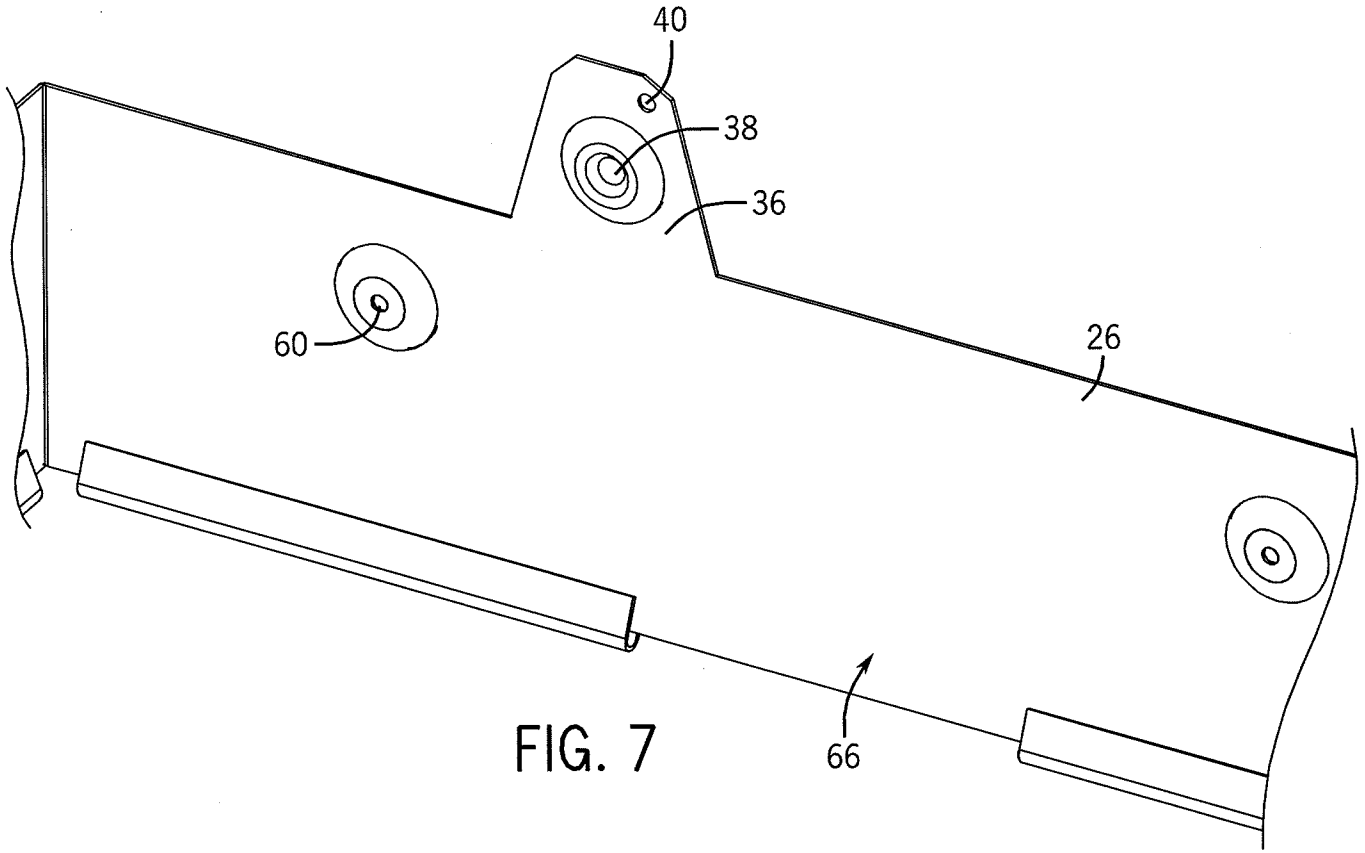
FIG. 7 is a view of a portion of the adaptor of FIG. 4.
Figure 8:
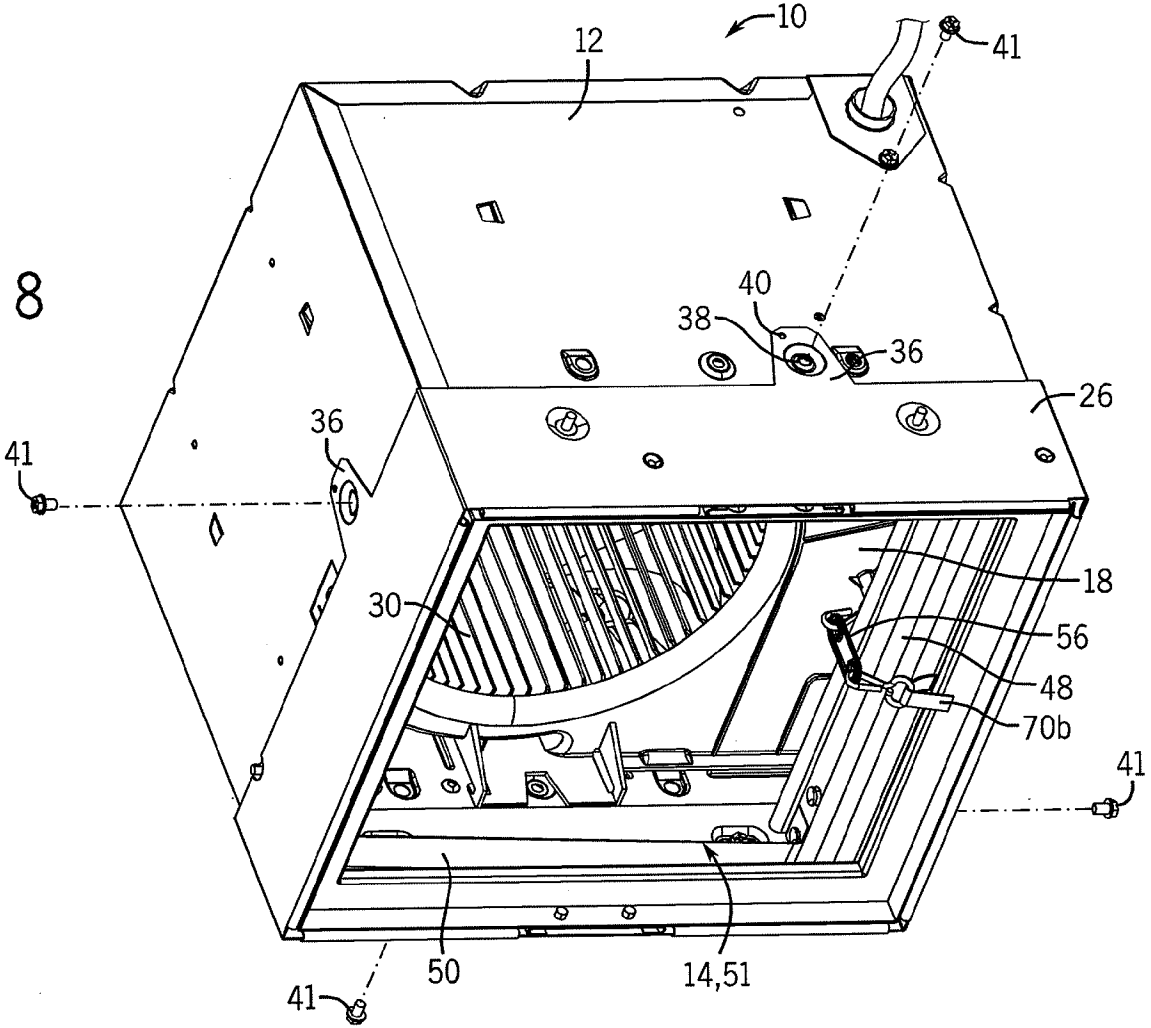
FIG. 8 is a perspective view of a ventilation system according to one embodiment of the invention.

As shown in FIGS. 7, 11, and 14, in some embodiments, a region of the frame 50 substantially adjacent to the frame apertures 58 and a region of the adaptor 26 substantially adjacent to the damper apertures 60 can comprise a substantially raised, embossed, or otherwise non-planar configuration. As a result, the region of the frame 50 adjacent to the frame apertures 58 can frictionally contact the region of the adaptor 26 adjacent to the damper apertures 60 to further support the coupling of the thermal damper assembly 48 and the adaptor 26.

Additionally, in some embodiments, the frame 50 can comprise a central aperture 51. In some embodiments, after the thermal damper assembly 48 is coupled to the adaptor 26 and/or the housing 12, the central aperture 51 can substantially align with the inlet 14 of the housing 12. As a result, air or other fluids can initially flow from the structure through the central aperture 51 and then through the inlet 14 and can be exhausted from the housing 12 via the outlet 16 and duct connector assembly 44.

In some embodiments, as shown in FIGS. 11, 13, and 14, the frame 50 can comprise at least one grille spring receiver 64. For example, in some embodiments, the frame 50 can comprise two grille spring receivers 64 disposed on opposite sides of the frame 50. In some embodiments, as shown in FIG. 7, the adaptor 26 can comprise one or more receiver recesses 66. As a result, in some embodiments, when the thermal damper assembly 48 is coupled to the adaptor 26, the grille spring receivers 64 can be positioned immediately adjacent to the receiver recesses 66. In some embodiments, as shown by the dashed lines in FIG. 9, one or more grille springs 68 can be coupled to the grille 24 and inserted into the grille spring receivers 64 on sides of the housing 12 and frame 50. Once positioned within the receiver recesses 66 and the grille spring receivers 64, the grille springs 68 can function to retain the grille 24 in a position immediately adjacent to the wall 22. Moreover, in some embodiments, the grille springs 68 can be configured and arranged so that a person wishing to access an interior of the ventilation system 10 need only pull on or otherwise actuate the grille 24 to reach the interior of the ventilation system 10. In other embodiments, the grille 24 can be coupled to the housing 12, adaptor 26, and/or the wall 22 using any other conventional coupling methods (e.g., coupling devices, adhesives, welding, etc.).

In some embodiments, the curtain 52 can be supported by the frame 50 and reversibly retained by the thermal link 56. For example, as shown in FIG. 11, the curtain 52 can be compressed or otherwise retained at a first end 67 of the frame 50. For example, in some embodiments, the frame 50 can comprise a first retaining element 70*a* and a second retaining element 70*b* disposed adjacent to (e.g., above and below) the curtain 52. Moreover, in some embodiments, the thermal link 56 can be coupled to the retaining elements 70*a*, 70*b*, as shown in FIG. 12. As a result, the combination of the thermal link 56 and retaining elements 70*a*, 70*b* can be configured and arranged to position the curtain 52 in a compressed configuration at the first end 67 of the frame 50. Accordingly, when the curtain 52 is in the compressed configuration, the central aperture 51 is substantially or completely unobstructed so that air or other fluids can enter the inlet 14.

In some embodiments, the thermal link 56 can be configured and arranged to at least partially enable expansion of the curtain 52. In some embodiments, the thermal link 56 can comprise a composition that can be structurally stable at some temperatures and structurally unstable at other temperatures. In some embodiments, the thermal link 56 can comprise a composition that can disintegrate or otherwise become structurally unstable at a temperature over a predetermined threshold. In some embodiments, the predetermined threshold can comprise a temperature of about 165 degrees Fahrenheit. For example, when the temperature around the ventilation system 10 exceeds the predetermined threshold (e.g., about 165 degrees Fahrenheit), the thermal link 56 can be become structurally unstable and/or structurally compromised so that the thermal link 56 can no longer retain the curtain 52 in the compressed configuration. As a result, when the temperature exceeds the predetermined threshold, the curtain 52 can expand and at least partially obstruct the central aperture 51.

In some embodiments, the frame 50 can comprise the biasing members 54 at a second end 69. As shown in FIG. 11, in some embodiments, the frame 50 can comprise two biasing members 54 disposed at the second end 69 and coupled to the curtain 52. For example, in some embodiments, after the temperature exceeds the predetermined threshold and the thermal link 56 becomes structurally unstable and/or compromised, the biasing members 54 can function to aid in extending and/or decompressing the curtain 52 across the central apertures 51.

In some embodiments, the curtain 52 can comprise a bendable, flexible, and otherwise compressible and substantially non-metallic composition. For example, in some embodiments, the curtain 52 can comprise any material that can be compressed or otherwise disposed at the first end 67 of the frame 50. In some embodiments, the curtain 52 can comprise a substantially ceramic composition. For example, the substantially ceramic curtain 52 can be compressed, folded, and/or otherwise retained in a defined space at the first end 67 so that, in the event that the temperature exceeds the predetermined threshold, the thermal link 56 can break or otherwise become compromised and the ceramic curtain 52 can at least partially extend over the central aperture 51 with the assistance of one or more of the biasing members 54.

In some embodiments, as a result of the curtain 52 at least partially extending from the first end 67 to the second end 69 of the frame 50, the central aperture 51 can become at least partially obstructed. As previously mentioned, by obstructing the central aperture 51, the inlet 14 and the rest of the ventilation system 10 can become at least partially displaced and/or at least partially thermally sealed from the local environment (e.g., a room of the structure). By way of example only, in some embodiments, the cause of the temperature of the local environment to exceed the predetermined threshold can comprise a thermal episode (e.g., a fire). In some embodiments, the curtain 52 can be configured and arranged to at least temporarily prevent the spread of heat, flames, and/or other thermal episode byproducts (e.g., effluent) to the ducts 46 and other portions of the structure.

In some embodiments, the curtain 52 can comprise alternative configurations. In some embodiments, the curtain 52 can be configured a substantially planar member that is pivotably disposed at the first end 67 and retained in place by the thermal link 56. For example, the curtain 52 can be disposed at the first end 67 in a position substantially parallel to a vertical axis of the system 10 and spring loaded. In some embodiment, once the temperature exceeds the predetermined threshold, the thermal link 56 can break and the spring-loaded curtain 52 can move from a position that is substantially parallel to the vertical axis to a position that is substantially perpendicular to the vertical axis (e.g., the curtain 52 can move about 90 degrees to substantially or completely seal the central aperture 51). In some embodiments, the curtain 52 can comprise a substantially bi-lobed configuration (not shown). For example, in some embodiments, the curtain 52 can comprise two or more members arranged in a substantially middle portion of the frame 50. In some embodiments, the curtain 52 can comprise two spring-loaded curtains 52 that move from a position substantially parallel to the vertical axis to a position substantially perpendicular to the vertical axis. For example, the two spring-loaded members can be positioned at a substantially middle point with respect to the frame 50. As a result, when the temperature exceeds the predetermined threshold, the two spring-loaded members will move to a position substantially perpendicular to the vertical axis of the system 10 to substantially obstruct and/or seal the central aperture 51.

In some embodiments, the ceramic curtain 52 can offer improvements over some conventional curtains. For example, some conventional curtain 52 can comprise one or more metal-based constituents. The metal-based constituents can readily conduct heat and other thermal energy from a thermal episode to portions of the ventilation system 10 (e.g., the ventilating assembly 18), which can lead to damage and/or spreading of the thermal episode. In some embodiments, the ceramic curtain 52 can be configured so that it does not readily conduct heat from the thermal episode to the ventilation system 10, which leads to improved protection for the ventilation system 10 components.

In some embodiments, the thermal damper assembly 48 can be uncoupled from the housing 12 and/or the adaptor 26 to enable access to the interior of the housing 12. In some embodiments, after the ventilation system 10 is installed and the grille 24 is attached via the grille springs 68, the process can be reversed to enable access to the interior of the ventilation system 10. For example, as reflected by the dashed lines in FIGS. 9 and 13, if an individual wishes to access the interior of the ventilation system 10 (e.g., access the motor 32 or other portions of the ventilating assembly 18 for repairs and/or maintenance), the grille 24 can be removed (e.g., by pulling on the grille 24 to disengage the grille springs 68) and the thermal damper assembly 48 can also be removed.

As shown in FIG. 13, the coupling devices can be removed so that the frame 50 can disengage from the adaptor 26 leading to the user being able to remove the thermal damper assembly 48 relative to the remainder of the ventilation system 10, which can remain installed within the wall 22. In some embodiments, the user can remove the coupling devices 41 from an internal portion of the thermal damper assembly 48. For example, the user lacks the ability to access an exterior portion system 10 after installation because the exterior portion of the housing 12, the adaptor 26, and/or the thermal damper assembly 48 can be substantially or completely inaccessible once the ventilation system 10 is installed within the wall 22 (e.g., because the system 10 is installed behind the wall 22), unless the user wishes to damage and repair the wall to enable access. As a result, the user can access the ventilation system 10 to uncouple the thermal damper assembly 48 from an interior portion of the assembly 48, housing 12, and the adaptor 26 (i.e., the user need not alter the wall 22 in order to remove the thermal damper assembly 28). For example, the user can actuate the coupling devices 41 (e.g., unscrew) from the interior of the thermal damper assembly 48 (e.g., the user can access the coupling devices 41 by reaching through the central aperture 51) so that the wall 22 need not be changed, damaged, or require repair after removing the thermal damper assembly 48. In some embodiments, at least a portion of the frame apertures 58 can be disposed at lateral ends of the frame 50, and in other embodiments, at least a portion of the frame apertures 58 at other locations.

After removing the thermal damper assembly 48, the user can have substantial or complete access to the interior of the housing 12 to perform and repairs, maintenance, and/or inspections. After the user accesses the interior of the ventilation system 10, the thermal damper assembly 48 and the grille 24 can be recoupled to the remainder of the system 10 and the system 10 can be reactivated for conventional use.

Some embodiments of the invention can offer improvements relative to some conventional ventilation systems 10. For example, although some conventional ventilation systems 10 can comprise a conventional thermal damper assembly 48, the assembly and disassembly (e.g., to enable access to the interior of the ventilation system 10) can be more complicated and destructive to the wall 22 and structure. Some conventional ventilation systems 10 and thermal damper assemblies 48 can be substantially or completely permanently coupled together so that in order to completely access the interior of the system 10, the user would have either remove a portion of the wall 22 or significantly damage the wall 22 (e.g., to access portions of the ventilation system 10). As a result, in order to perform repairs, maintenance, and/or inspections within the conventional ventilation system 10, the user would be required to damage the wall 22 and then repair the wall 22 to its original state after accessing the ventilation system 10. Some embodiments provide an advantage over the conventional system 10. For example, by being able to couple and uncouple the thermal damper assembly 48 relative to the adaptor 26, the user can more easily access the interior of the housing 12 without the need to damage and/or repair the wall 22 surrounding the ventilation system 10.

Figure 15:
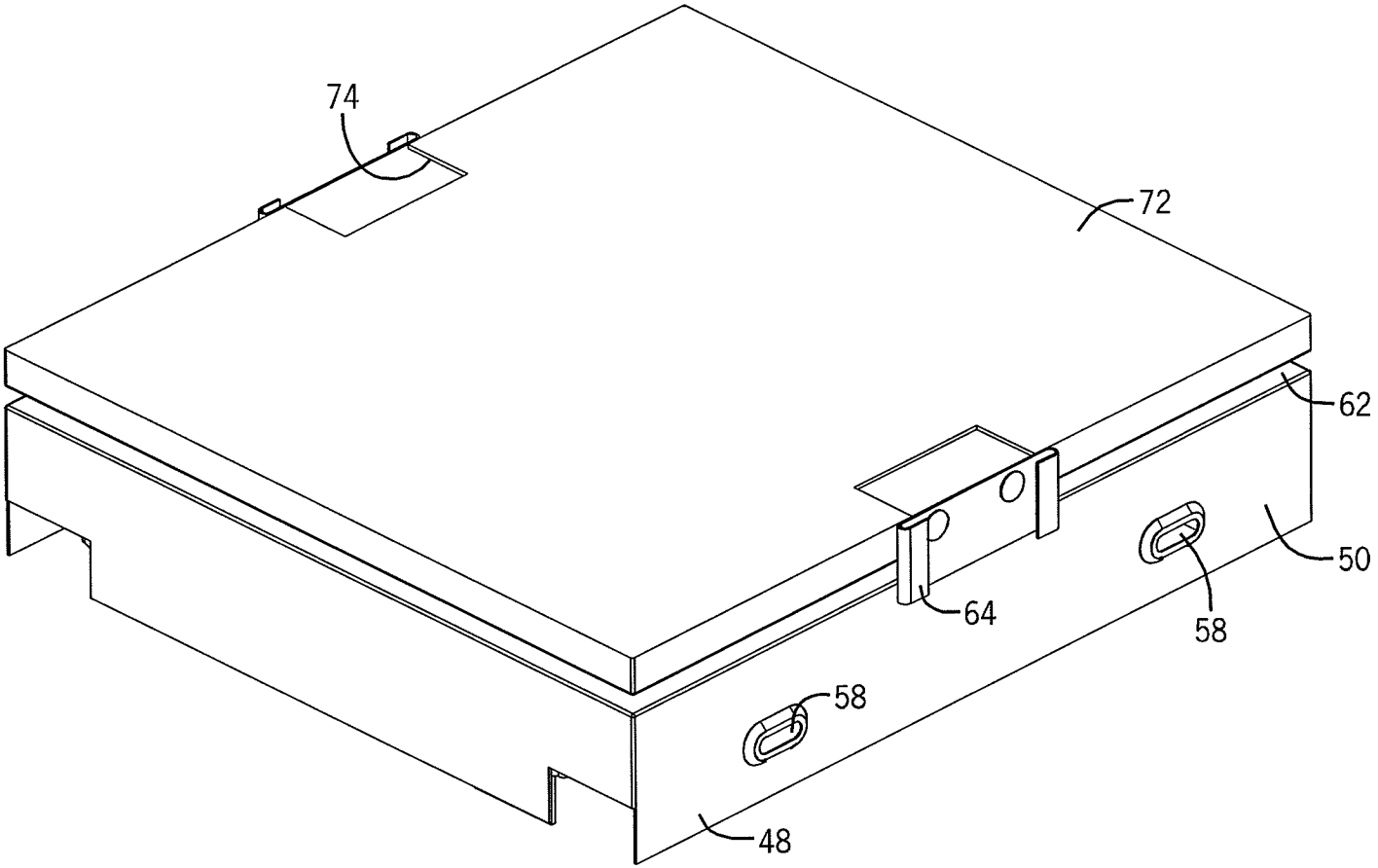
FIG. 15 is a perspective view of a guard member and a thermal damper assembly according to one embodiment of the invention.
Figure 16:
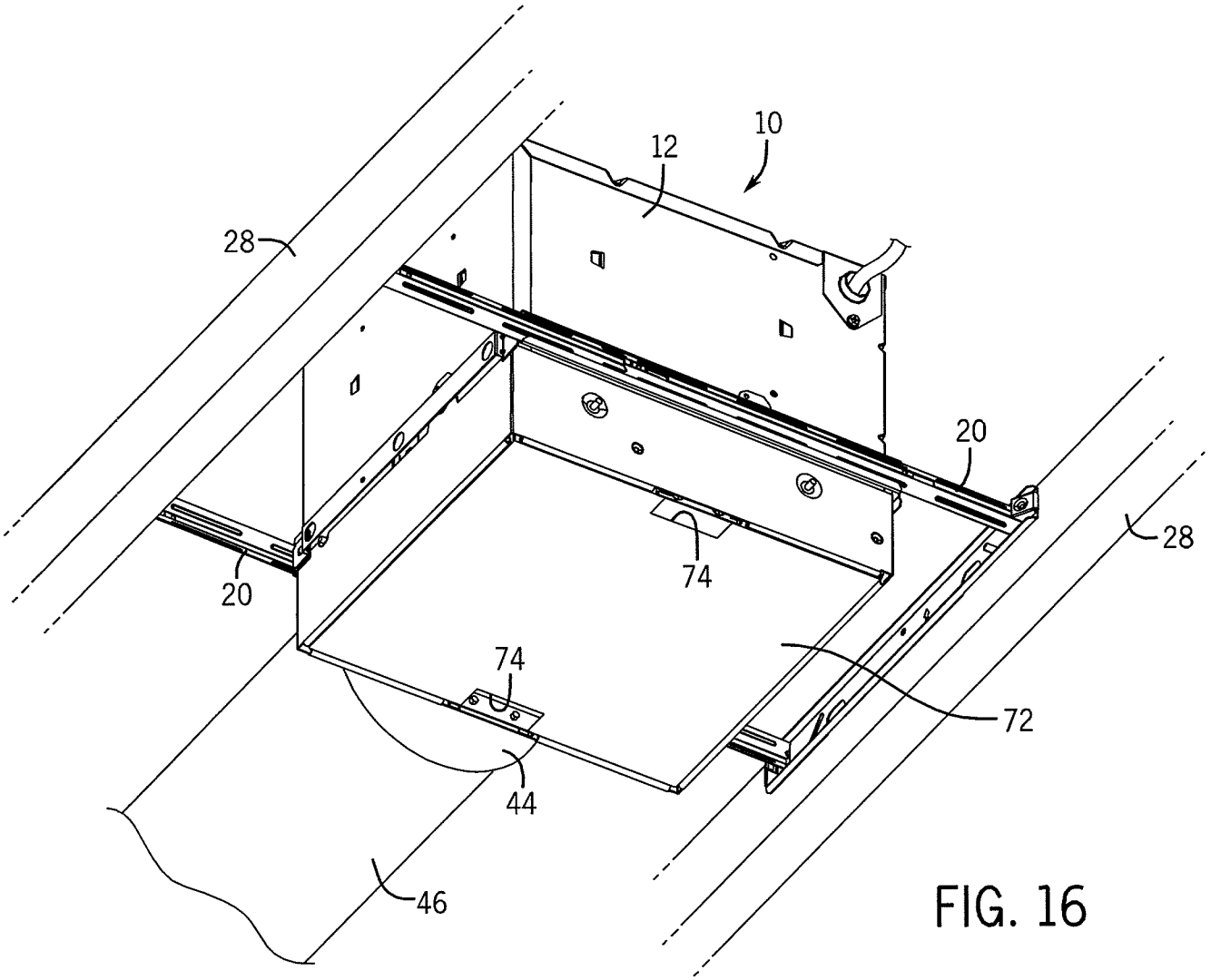
FIG. 16 is a perspective view of an installed ventilation system with a guard member according to one embodiment of the invention.

In some embodiments, the ventilation system 10 can comprise a guard member 72. For example, as shown in FIGS. 15 and 16, the guard member 72 can be configured and arranged to be coupled to at least one of the frame 50, the adaptor 26, and the housing 12. In some embodiments, the guard member 72 can be coupled to the ventilation system 10 during installation of the system 10 within the structure. As shown in FIGS. 15 and 16, the guard member 72 can obstruct at least a portion of the central aperture 51 and, accordingly, the inlet 14 so that at least a portion of the components within the housing 12 (e.g., the ventilating assembly 18) can be substantially sealed relative to the exterior of the ventilation system 10. As a result, after substantial or complete installation of the ventilation system 10 within the structure, but before completion of the structure itself, any debris associated with construction of the structure can be at least partially prevented from entering the interior of the housing 12. In some embodiments, the guard member 72 can be configured and arranged so that no coupling devices 41, fasteners, adhesives, or other coupling methods are needed. For example, in some embodiments, the guard member 72 can comprise one or more self-holding elements at its corners that are capable of at least partially retaining the guard member 72 in position.

By way of example only, in some embodiments, after the ventilation system 10 is installed within a home or office, the guard member 72 can be positioned to substantially seal the interior of the housing 12 during completion of the construction of the room into which the system 10 is installed or completion of the entire structure. As a result, at least a portion of the debris associated with the continued construction of the structure can be kept away from the interior of the housing 12, which can lead to a lessened risk of the debris contacting and potentially damaging the moving parts of the system 10. In some embodiments, the guard member 72 can comprise one or more access features 74, which can be used to remove the guard member 72 from the remainder of the ventilation system 10.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A ventilation system comprising:

a housing including an inlet through which air is received within the housing and an outlet through which the air exits the housing, the housing being capable of being installed substantially within a structure;

a ventilating assembly being supported in the housing and operable to generate a flow of air;

a thermal damper assembly comprising a substantially non-metallic curtain positioned within a frame; and an adaptor capable of being coupled to the housing such that the adaptor is flush with the housing, the adaptor having at least one aperture for receiving a fastener for releasbly coupling the adaptor to the frame of the thermal damper assembly within an opening defined by the adaptor for operably coupling the thermal damper assembly to the housing, wherein the adaptor is configured and arranged to be uncoupled from the housing after the housing has been installed within the structure to release the thermal damper assembly from the housing, wherein a region of the frame of the thermal damper frictionally engages the adaptor to assist retention of the thermal damper assembly within the opening of the adaptor.

2. The ventilation system of claim 1, wherein the substantially non-metallic curtain comprises a ceramic curtain.

3. The ventilation system of claim 1, wherein the thermal damper assembly comprises one or more frame apertures defined through the frame, a thermal link, and one or more biasing members coupled to the frame and the substantially non-metallic curtain.

4. The ventilation system of claim 1, wherein the thermal damper assembly is configured and arranged so that the thermal damper assembly is capable of being uncoupled from the housing through an interior of the thermal damper assembly.

5. The ventilation system of claim 1 and further comprising a grille movably coupled to at least one of the thermal damper assembly and the housing.

6. The ventilation system of claim 1, wherein the adaptor comprises one or more mounting apertures that are configured and arranged to receive one or more mounting wires that are capable of aiding in installation of the housing within the structure.

7. The ventilation system of claim 1 and further comprising a guard member, and wherein the guard member is configured and arranged to be coupled to one of the thermal damper assembly and the housing during installation of the housing within the structure.

8. The ventilation system of claim 1 and further comprising a mounting assembly being capable of being coupled to the housing to aid in installing the housing within the structure.

9. The ventilation system of claim 1, wherein the thermal damper assembly is configured and arranged to at least partially seal the inlet when a temperature adjacent to the thermal damper assembly is at or above a predetermined threshold.

10. A ventilation system comprising:

a housing including an inlet through which air is received within the housing, the housing being capable of being installed within a structure;

a ventilating assembly being supported within an interior of the housing and operable to generate a flow of air, the ventilating assembly being in fluid communication with the inlet;

a thermal damper assembly comprising a frame defining an aperture and a substantially non-metallic curtain, and an adaptor capable of being coupled to the housing such that the adaptor is flush with the housing, the adaptor having at least one aperture for receiving a fastener for releasbly coupling the thermal damper assembly for operably coupling the thermal damper assembly to the housing, wherein the adaptor is configured and arranged to be uncoupled from the housing after the housing has been installed within the structure to release the thermal damper assembly from the housing, wherein a region of the frame of the thermal damper frictionally engages the adaptor to assist retention of the thermal damper assembly to the adaptor;

wherein the thermal damper assembly is configured and arranged to be uncoupled from the adaptor after the housing has been installed within the structure to provide access to the interior of the housing through the inlet of the housing.

11. The ventilation system of claim 10, wherein the thermal damper assembly is configured and arranged to at least partially seal the inlet of the housing when a temperature adjacent to the thermal damper assembly is at or above a predetermined threshold.

12. The ventilation system of claim 10, wherein the thermal damper assembly is configured and arranged so that the thermal damper assembly is capable of being uncoupled from the housing through an interior of the thermal damper assembly.

13. The ventilation system of claim 10, and further comprising a mounting assembly being capable of being coupled to the housing to aid in installing the housing within the structure.

14. The ventilation system of claim 10, wherein the housing comprises one or more mounting apertures that are configured and arranged to receive one or more mounting wires that are capable of aiding in installation of the housing within the structure.

15. The ventilation system of claim 10 and further comprising a guard member, and wherein the guard member is configured and arranged to be coupled to the thermal damper assembly to substantially seal the inlet of the housing and the aperture of the thermal damper assembly during installation of the housing within the structure.

16. The ventilation system of claim 10, wherein the substantially non-metallic curtain comprises a ceramic curtain.

17. A ventilation system comprising:

a housing including an inlet through which air is received within the housing, the housing being capable of being installed within a structure;

a ventilating assembly being supported within an interior of the housing and operable to generate a flow of air, the ventilating assembly being in fluid communication with the inlet; and a thermal damper assembly comprising a frame defining an aperture, a substantially non-metallic curtain comprising ceramic, and a central aperture, the thermal damper assembly being capable of being coupled to the housing so that the central aperture of the thermal damper assembly and the inlet of the housing are in fluid communication with each other;

an adaptor capable of being coupled to the housing such that the adaptor is flush with the housing and defining an opening for receiving the thermal damper assembly, the adaptor having at least one aperture for receiving a fastener;

wherein the frame is configured to receive the fastener to be coupled to the adaptor and uncoupled from the adaptor through an interior of the thermal damper assembly after the housing has been installed within the structure to provide access to the interior of the housing through the inlet of the housing, wherein a region of the frame of the thermal damper frictionally engages the adaptor to assist retention of the thermal damper assembly within the opening of the adaptor.

18. The ventilation system of claim 17, wherein the thermal damper assembly comprises a frame, one or more frame apertures defined through the frame, a thermal link, and one or more biasing members coupled to the frame and the substantially non-metallic curtain.

* * * * *